US012023727B2

(12) United States Patent
Grealy

(10) Patent No.: US 12,023,727 B2
(45) Date of Patent: Jul. 2, 2024

(54) STARTING HEAD FOR A CONTINUOUS CASTING MOLD AND ASSOCIATED METHOD

(71) Applicant: WAGSTAFF, INC., Spokane Valley, WA (US)

(72) Inventor: Gary Patrick Grealy, Liberty Lake, WA (US)

(73) Assignee: WAGSTAFF, INC., Spokane Valley, WA (US)

( * ) Notice: Subject to any disclaimer, the term of this patent is extended or adjusted under 35 U.S.C. 154(b) by 261 days.

(21) Appl. No.: 17/653,205

(22) Filed: Mar. 2, 2022

(65) Prior Publication Data

US 2022/0362838 A1 Nov. 17, 2022

Related U.S. Application Data

(60) Provisional application No. 63/201,728, filed on May 11, 2021.

(51) Int. Cl.
*B22D 11/08* (2006.01)

(52) U.S. Cl.
CPC ..... *B22D 11/083* (2013.01)

(58) Field of Classification Search
CPC ..... B22D 11/081; B22D 11/083
See application file for complete search history.

(56) References Cited

U.S. PATENT DOCUMENTS 5,027,889 A 7/1991 Thorner et al.
5,947,183 A * 9/1999 Schneider ..... B22D 11/083 164/445
8,365,808 B1 * 2/2013 Tilak ..... B22D 11/18 164/415

(Continued)

FOREIGN PATENT DOCUMENTS

CN 102137727 A 7/2011
CN 111054896 A * 4/2020

(Continued)

OTHER PUBLICATIONS

International Search Report and Written Opinion for PCT/US2022/028719 (ISA/ED) mailed Jul. 21, 2022 (12 pages).

(Continued)

*Primary Examiner* — Kevin E Yoon
(74) *Attorney, Agent, or Firm* — ALSTON & BIRD LLP

(57) ABSTRACT

Provided herein is a method and apparatus for a starting head for a continuous casting mold, and more particularly, to a starting head configured to clinch a casting for drawing the casting from a continuous casting mold in a manner that reduces stresses within the casting decreasing the likelihood of stress cracks forming in the casting. An example starting head for a continuous casting mold includes: a body; a top surface of the body; two or more recesses defined within the top surface, where each recess extends from a first end to a second end, where the first end of a respective recess is closer to a center of the top surface than the second end of the respective recess, and where a depth of the first end of the respective recess relative to the top surface is less than a depth of the second end of the respective recess relative to the top surface; and a clinch point defined by the second end of the respective recess.

19 Claims, 9 Drawing Sheets

(56) References Cited

U.S. PATENT DOCUMENTS

| | | | | |
|---|---|---|---|---|
| 2016/0325346 | A1* | 11/2016 | Charles | B22D 11/083 |
| 2019/0076918 | A1* | 3/2019 | Zhang | B22D 11/049 |

FOREIGN PATENT DOCUMENTS

| | | | | |
|---|---|---|---|---|
| CN | 111299530 | A | * | 6/2020 |
| EP | 3546086 | A1 | | 10/2019 |

OTHER PUBLICATIONS

Taiwan Office Action w/Search Report for Taiwan Patent Application No. 111117586 dated Nov. 27, 2023 with English translation (13 pages).

* cited by examiner

STARTING HEAD FOR A CONTINUOUS CASTING MOLD AND ASSOCIATED METHOD

CROSS-REFERENCE TO RELATED APPLICATIONS

This application claims priority to U.S. Patent Application Ser. No. 63/201,728, filed on May 11, 2021, the contents of which are hereby incorporated by reference in their entirety.

TECHNOLOGICAL FIELD

The present disclosure relates to a method and apparatus for a starting head for a continuous casting mold, and more particularly, to a starting head configured to clinch a casting for drawing the casting from a continuous casting mold in a manner that reduces stresses within the casting decreasing the likelihood of stress cracks forming in the casting.

BACKGROUND

Metal products may be formed in a variety of ways; however numerous forming methods first require an ingot, billet, or other cast part that can serve as the raw material from which a metal end product can be manufactured, such as through rolling or machining, for example. One method of manufacturing an ingot or billet is through a continuous casting process known as direct chill casting, whereby a vertically oriented mold cavity is situated above a platform that translates vertically down a casting pit. A starting head or starting block may be situated on the platform and form a bottom of the mold cavity, at least initially, to begin the casting process. Molten metal is poured into the mold cavity whereupon the molten metal cools and the solidification process begins, typically using a cooling fluid. The platform with the starting head thereon may descend into the casting pit at a predefined speed to allow the metal exiting the mold cavity and descending with the starter block to solidify. The platform continues to be lowered as more molten metal enters the mold cavity, and solid metal exits the mold cavity. This continuous casting process allows metal ingots and billets to be formed according to the profile of the mold cavity and having a length limited only by the casting pit depth and the hydraulically actuated platform moving therein.

As the direct chill casting process relies upon at least partial metal solidification while the metal is within the direct chill casting mold, before the starting head begins its descent, there is a risk of the casting solidifying within the direct chill casting mold and not descending with the starting head due to distortion in the casting caused by the solidification process. To avoid this issue, a starting head may be configured to frictionally engage the butt of the cast billet to pull the butt from the mold as the starting head begins its descent. This frictional engagement can result in unwanted stresses in the butt of the casting that may cause cracks or other undesirable properties within the casting.

BRIEF SUMMARY

The present disclosure relates to a method and apparatus for a starting head for a continuous casting mold, and more particularly, to a starting head configured to clinch a casting for drawing the casting from a continuous casting mold in a manner that reduces stresses within the casting decreasing the likelihood of stress cracks forming in the casting.

Embodiments provided herein include a starting head for a continuous casting mold including: a body; a top surface of the body, where two or more recesses are defined within the top surface, where each recess extends from a first end to a second end, where the first end of a respective recess is closer to a center of the top surface than the second end of the respective recess, and where a depth of the first end of the respective recess relative to the top surface is less than a depth of the second end of the respective recess relative to the top surface; and a clinch point defined by the second end of the respective recess. According to an example embodiment, in response to molten casting material received onto the starting head, the molten casting material solidifies within the recesses defined in the top surface and the clinch points defined by the second end of the respective recess engage the solidified casting material enabling the starting head to draw the solidified casting material from a continuous casting mold.

According to an example embodiment, each of the two or more recesses extend along an arc of less than 180-degrees relative to the center of the top surface. Each of the two or more recesses, in certain embodiments, define a clinch surface at the second end of the respective recess, the clinch surface extending from the top surface to a bottom of the recess at the depth of the second end of the respective recess. The clinch surface of the respective recess of an example embodiment defines an undercut, where at least a portion of the top surface overlies the respective recess.

The clinch surface of an example embodiment is positioned at a clinch angle divergent from an axis parallel to a direction of travel of the starting head into a casting pit during a casting operation. The two or more recesses of an example embodiment are positioned with centers spaced in equal angular increments about the center of the top surface of the body. The two or more recesses of certain embodiments include three recesses positioned with centers 120-degrees apart from one another relative to the center of the top surface of the body. The two or more recesses of certain embodiments include four recesses positioned with centers 90-degrees apart from one another relative to the center of the top surface of the body. The top surface of the body of an example embodiment is concave. According to an example embodiment, a height difference between an outer edge of the top surface of the body and a height of the lowest point of the concave top surface is no more than two inches. A maximum depth of the two or more recesses relative to the outer edge of the top surface is, in some embodiments, no more than two inches.

Embodiments provided herein include a continuous casting mold system including: a continuous casting mold defining a mold cavity; a starting head including a top surface, the starting head configured to engage a bottom of the continuous casting mold and seal a bottom side of the mold cavity with the top surface, where two or more recesses are defined within the top surface, where each recess extends from a first end to a second end, where the first end of a respective recess is closer to a center of the top surface than the second end of the respective recess, and where a depth of the first end of the respective recess relative to the top surface is less than a depth of the second end of the respective recess relative to the top surface; and a clinch point defined by the second end of the respective recess.

According to certain embodiments, each of the two or more recesses extend along an arc of less than 180-degrees relative to the center of the top surface. According to some embodiments, each of the two or more recesses define a clinch surface at the second end of the respective recess, the clinch surface extending from the top surface to a bottom of the recess at the depth of the second end of the respective recess. The clinch surface of the respective recess of some embodiments defines an undercut, where at least a portion of the top surface overlies the respective recess. The clinch surface of an example embodiment is positioned at a clinch angle divergent from an axis parallel to a direction of travel of the starting head into a casting pit during a casting operation.

According to some embodiments, the two or more recesses are positioned with centers spaced in equal angular increments about the center of the top surface of the body. The two or more recesses of some embodiments include three recesses positioned with centers 120-degrees apart from one another relative to a center of the top surface of the body. The two or more recesses of some embodiments include four recesses positioned with centers 90-degrees apart from one another relative to a center of the top surface of the body. The top surface of the body of some embodiments is concave, where a height difference between an outer edge of the top surface of the body and a height of the lowest point of the concave top surface is no more than two inches, and where a maximum depth of the two or more recesses relative to an outer edge of the top surface is no more than two inches.

BRIEF DESCRIPTION OF THE DRAWINGS

Figure 1:
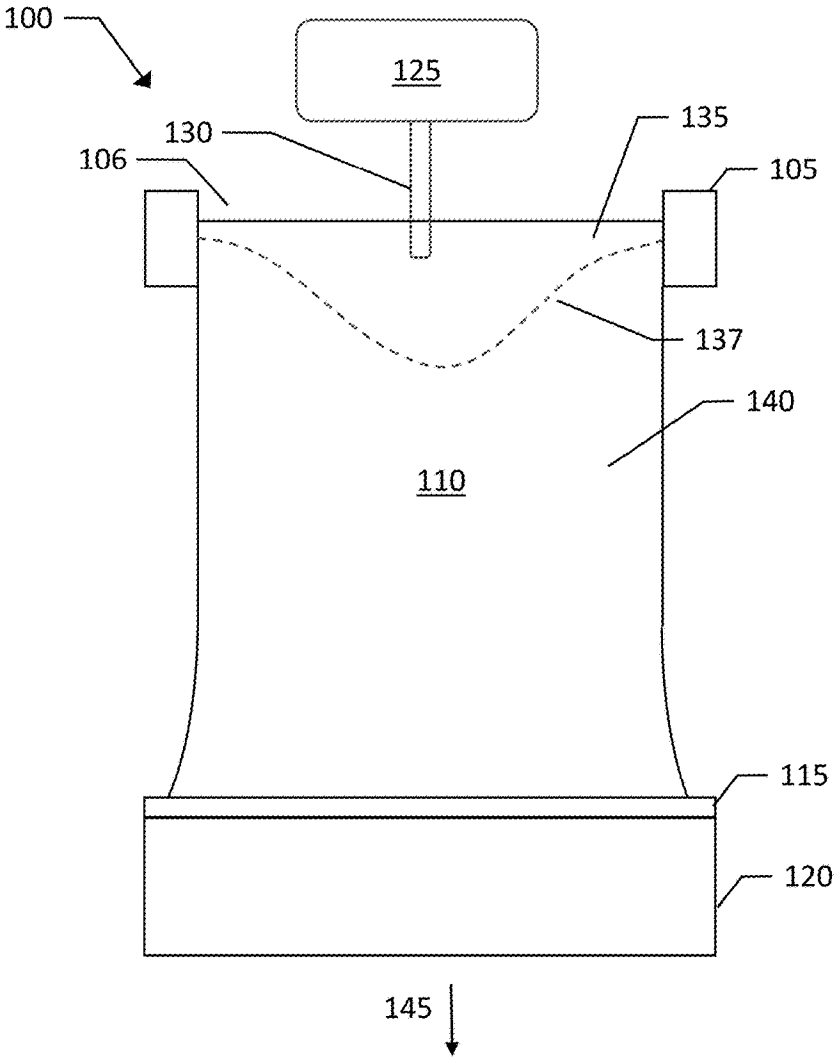
FIG. 1 (PRIOR ART)
Figure 2:
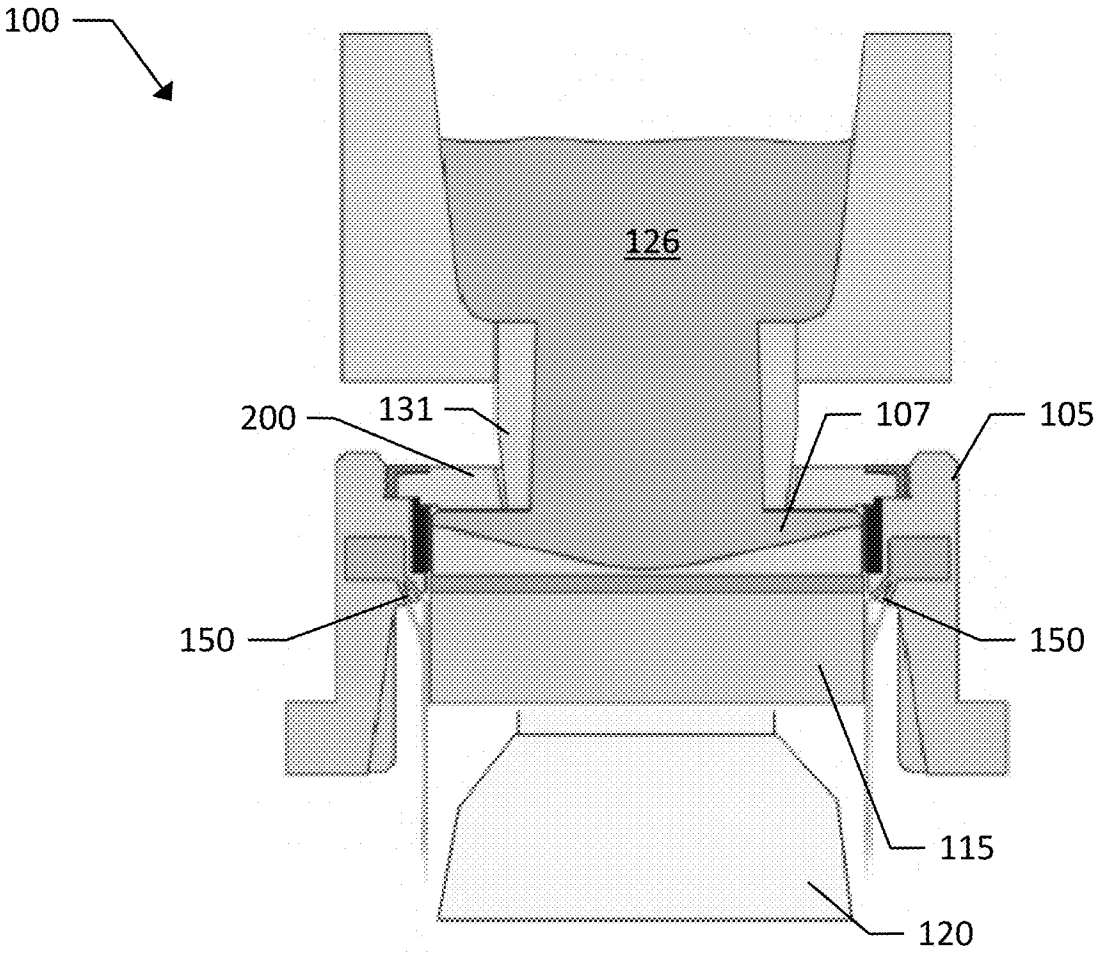
Figure 3:
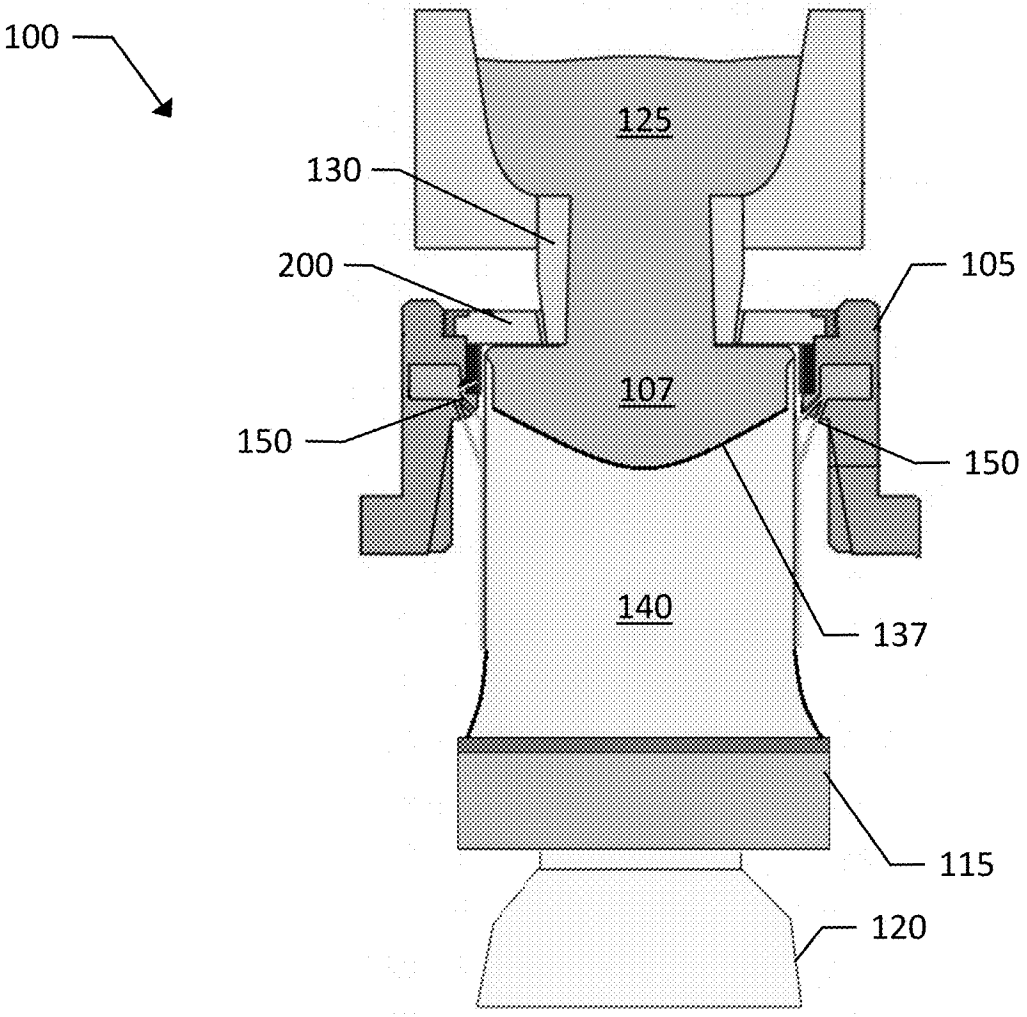
Figure 4:
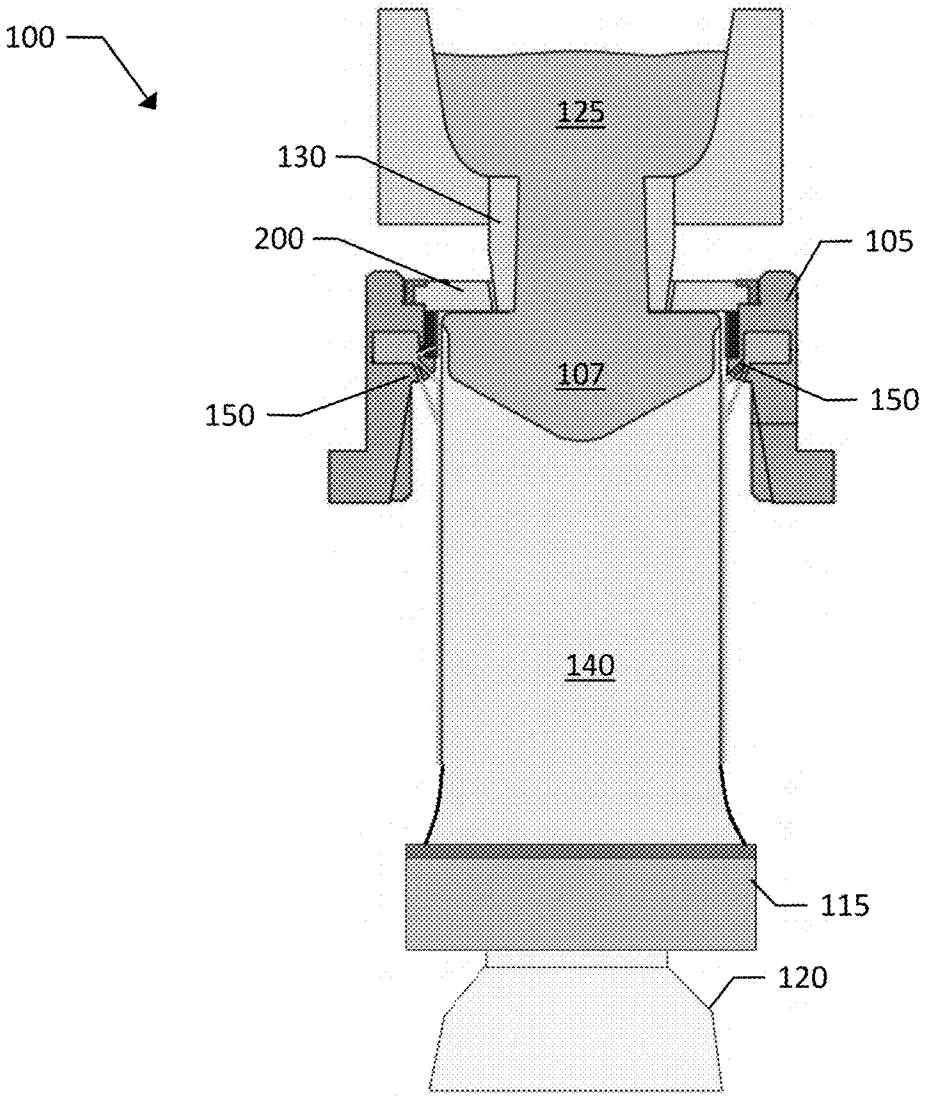
Figure 5B:
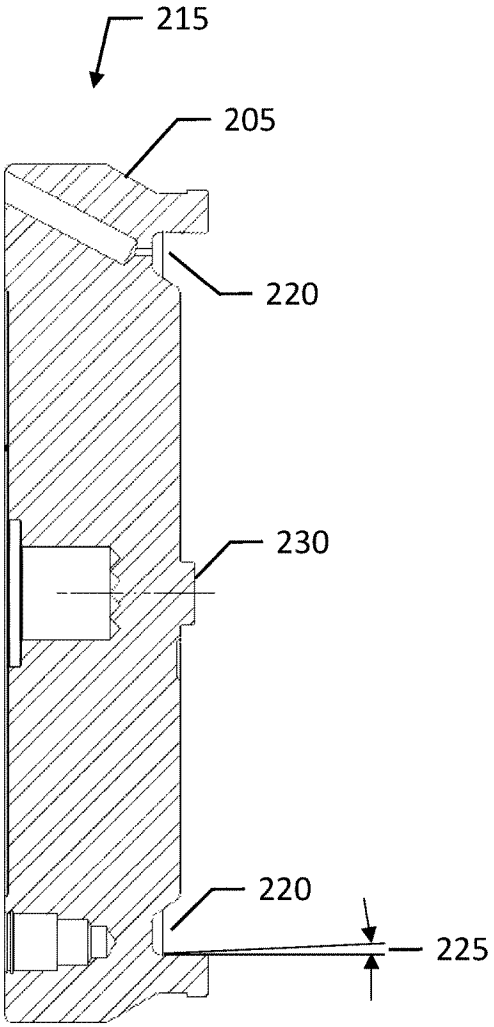
FIG. 5B PRIOR ART
Figure 5A:
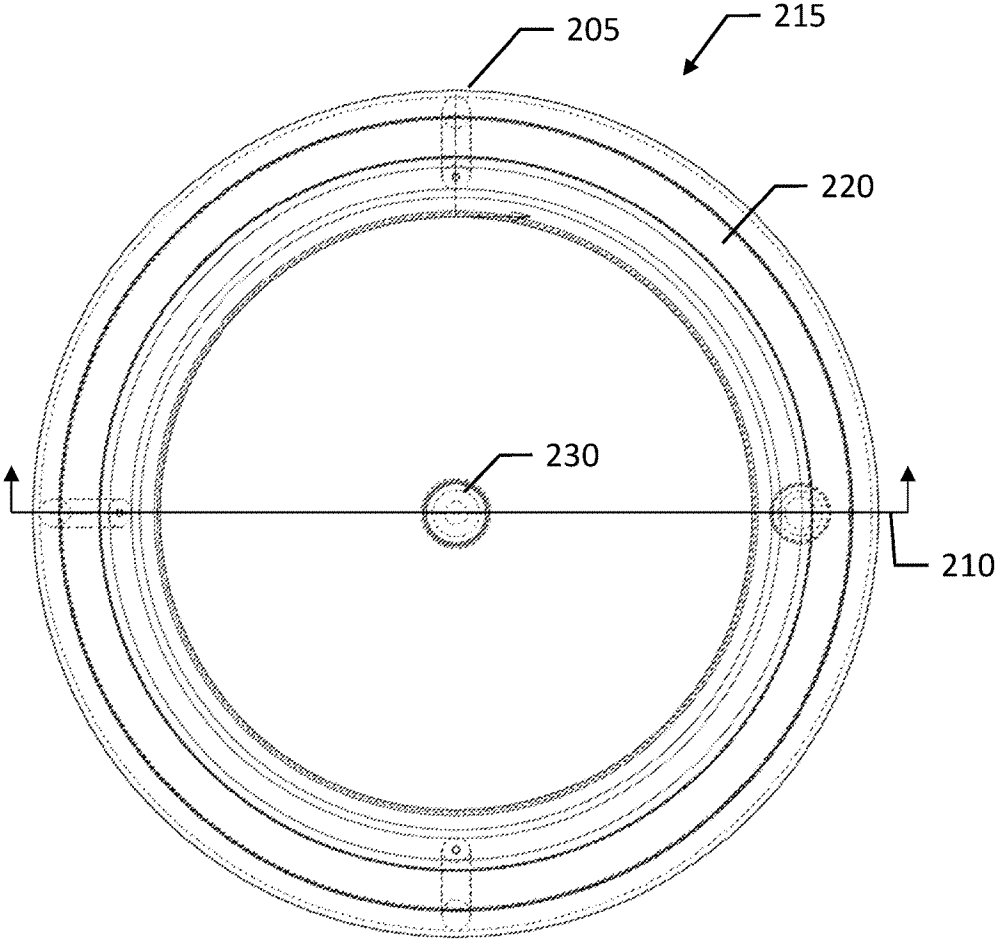
FIG. 5A PRIOR ART
Figure 6B:
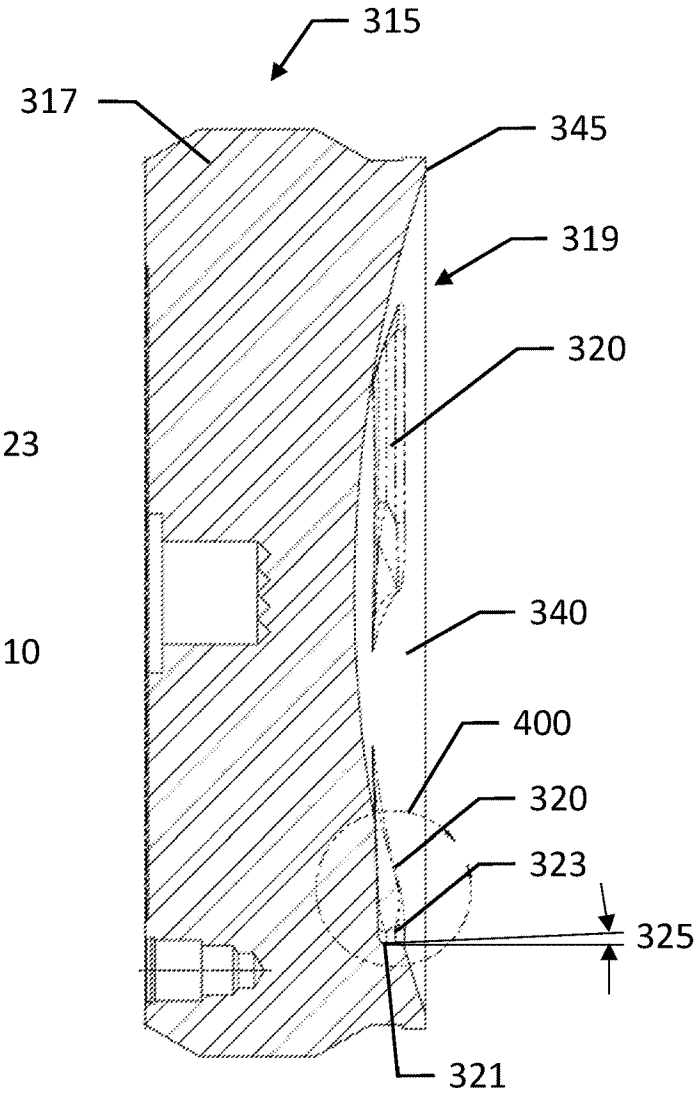
Figure 6A:
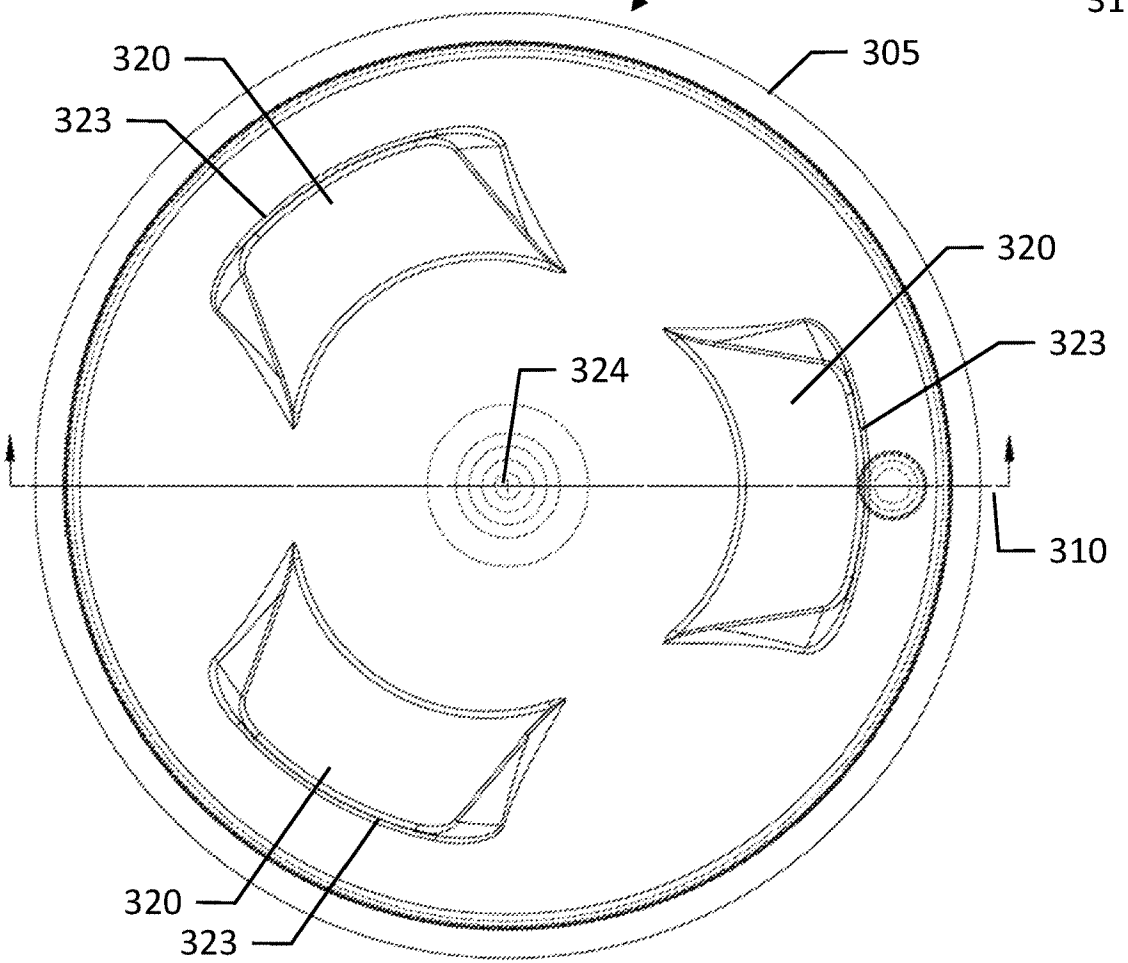
Figure 7:
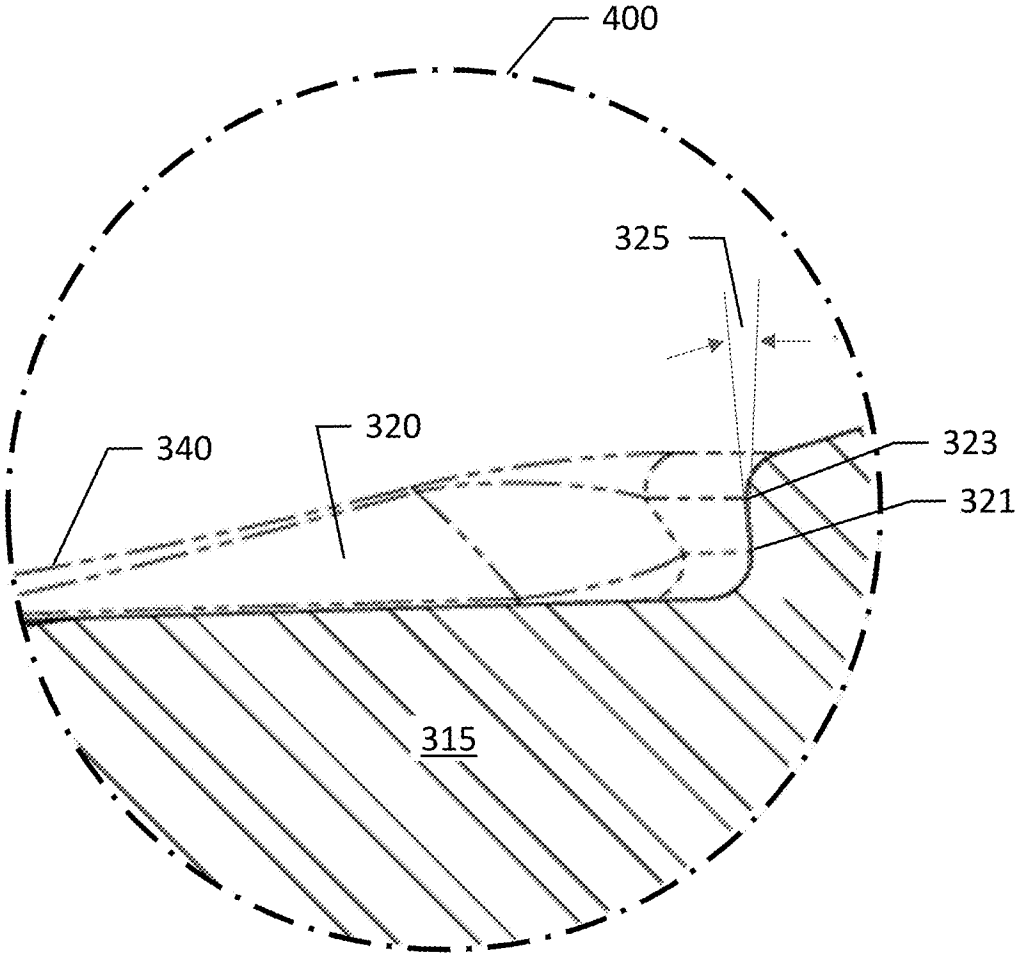
Figure 8:
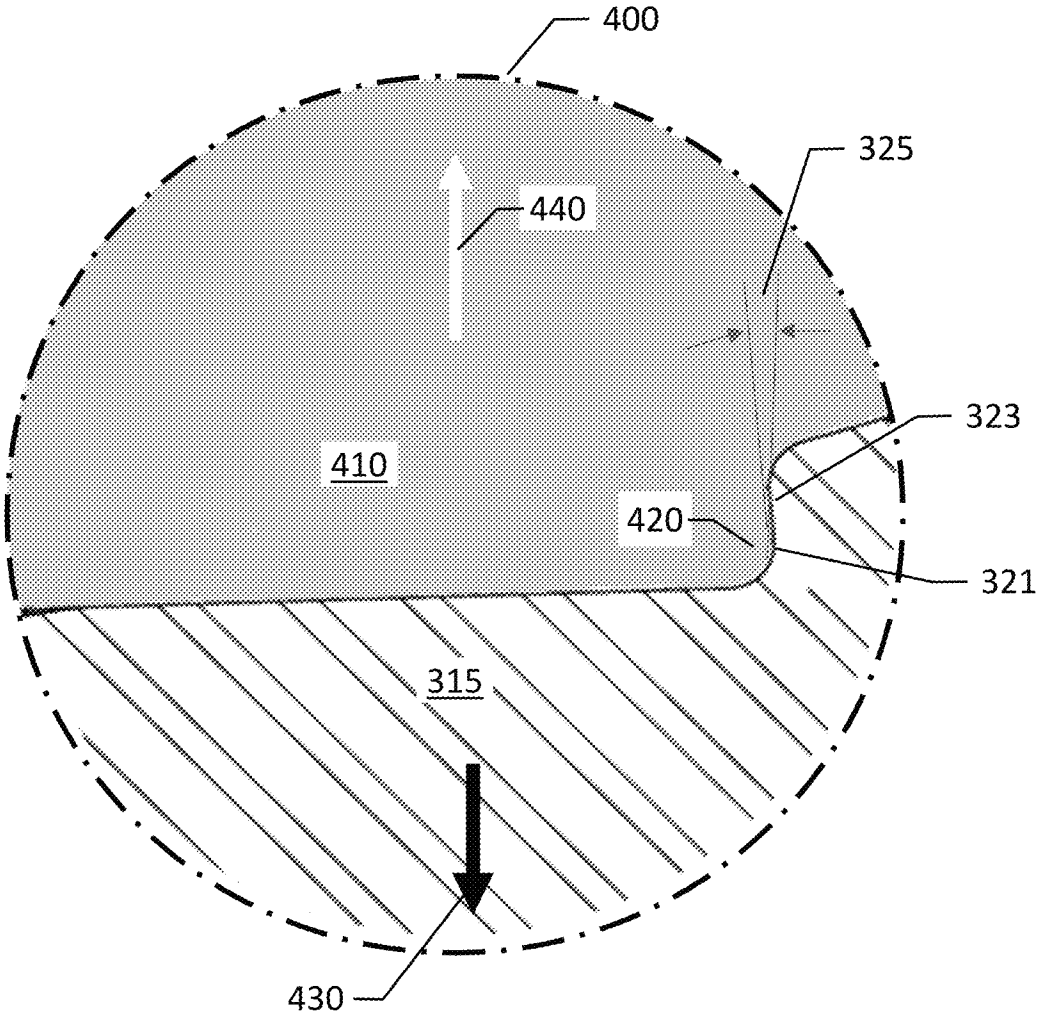
Figure 9:
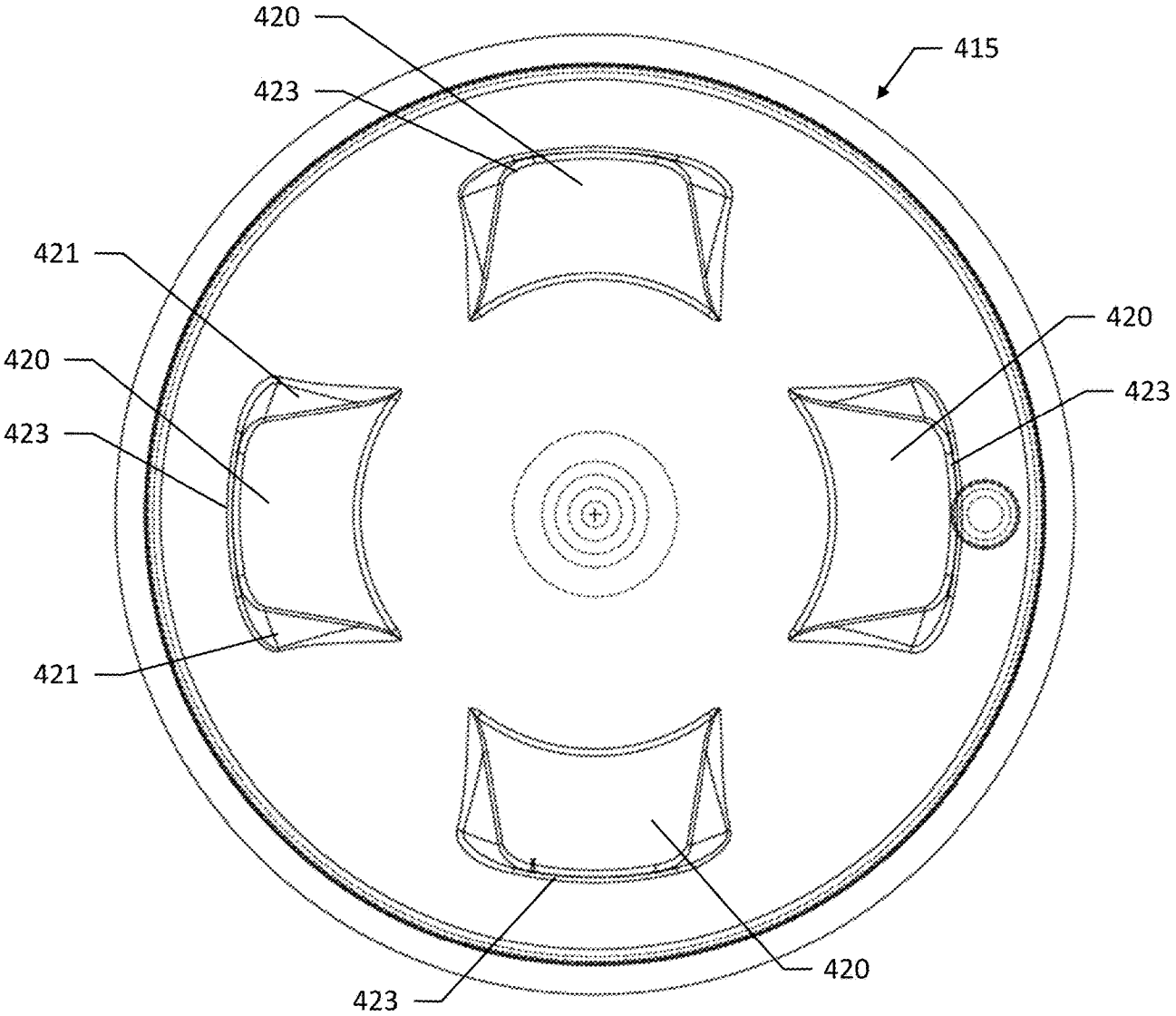

Having thus described the invention in general terms, reference will now be made to the accompanying drawings, which are not necessarily drawn to scale, and wherein:

FIG. 1 illustrates an example embodiment of a direct chill casting mold according to the prior art;

FIG. 2 illustrates an example of the initial stages of direct chill casting or continuous casting according to an example embodiment of the present disclosure;

FIG. 3 illustrates an example embodiment following the initial stages of direct chill casting according to an example embodiment of the present disclosure;

FIG. 4 illustrates an example embodiment of steady-state direct chill casting according to an example embodiment of the present disclosure;

FIG. 5A illustrates a top view of a starting head of the prior art;

FIG. 5B illustrates a cross-section view of the starting head of FIG. 5A taken along a section line;

FIG. 6A illustrates a top view of a starting head according to an example embodiment of the present disclosure;

FIG. 6B illustrates a cross-section view of the starting head of FIG. 6A taken along a section line according to an example embodiment of the present disclosure;

FIG. 7 illustrates a detail view of a recess of the starting head of FIG. 6A according to an example embodiment of the present disclosure;

FIG. 8 illustrates another detail view of the recess of the starting head of FIG. 6A engaged by cast material according to an example embodiment of the present disclosure; and FIG. 9 illustrates a top view of a starting head according to another example embodiment of the present disclosure.

DETAILED DESCRIPTION

Example embodiments of the present disclosure now will be described more fully hereinafter with reference to the accompanying drawings, in which some, but not all embodiments of the disclosure are shown. Indeed, embodiments may take many different forms and should not be construed as limited to the embodiments set forth herein; rather, these embodiments are provided so that this disclosure will satisfy applicable legal requirements. Like numbers refer to like elements throughout.

Embodiments of the present disclosure generally relate to a method and apparatus for a continuous casting starting head, and more particularly, to a starting head configured to clinch a casting for drawing the casting from a continuous casting or direct chill casting mold in a manner that reduces stresses within the casting decreasing the likelihood of stress cracks forming in the cast casting. Embodiments employ unique profiles of the starting head to engage a butt of the casting to draw the casting from the direct chill casting mold as the starting head descends into the casting pit, while reducing stresses within the butt of the casting thereby reducing undesirable properties in the butt of the casting and reducing waste. Embodiments thereby improve the efficiency of the casting process by producing a casting with less waste and greater consistency, particularly in the butt of the casting.

Direct chill casting or continuous casting is a process used to produce ingots or billets that may have a variety of cross-sectional shapes and sizes for use in a variety of manufacturing applications. The process of direct chill casting begins with a horizontal mold table or mold frame containing one or more vertically-oriented molds disposed therein. Each of the molds defines a mold cavity, where the mold cavities are initially closed at the bottom with a starting head to seal the bottom of the mold cavity. Molten metal is introduced to each mold cavity through a metal distribution system to fill the mold cavities. As the molten metal proximate the bottom of the mold, adjacent to the starting head, solidifies as the butt of the casting, the starting head is moved vertically downward along a linear path into a casting pit. The movement of the starting head may be caused by a hydraulically-lowered platform to which the starting head is attached. The movement of the starting head vertically downward draws the solidified metal from the mold cavity while additional molten metal is introduced into the mold cavities. Once started, this process moves at a relatively steady-state for a continuous casting process that forms a metal ingot or billet having a profile defined by the mold cavity, and a height defined by the depth to which the platform and starting head are moved.

During the casting process, the mold itself is cooled to encourage solidification of the metal prior to the metal exiting the mold cavity as the starting head is advanced downwardly, and a cooling fluid is introduced to the surface of the metal proximate the exit of the mold cavity as the metal is cast to draw heat from the cast metal billet and to solidify the molten metal within the now-solidified shell of the billet. As the starter block is advanced downward, the cooling fluid may be sprayed directly on the billet to cool the surface and to draw heat from within the core of the billet.

FIG. 1 depicts a general illustration of a cross-section of a direct chill casting mold 100 during the continuous casting process. The illustrated mold could be for a round billet or a substantially rectangular ingot, for example. As shown, the continuous casting mold 105 forms a mold cavity 106 from which the cast part 110 is formed. The casting process begins with the starting head 115 sealing or substantially filling the bottom of the mold cavity 106 against mold walls of the continuous casting mold 105. As the platform 120 moves down along arrow 145 into a casting pit and the cast part begins to solidify at its edges within the mold walls of the continuous casting mold 105, the cast part 110 exits the mold cavity 106. Metal flows from pouring trough 125, which may be a heated reservoir or a reservoir fed from a furnace, for example, through spout 130 into the mold cavity. As shown, the spout 130 is partially submerged within a molten pool of metal 135 to avoid oxidation of metal that would occur if fed from above the molten metal pool 135. The molten metal begins solidification as the temperature of the molten metal cools. FIG. 1 further illustrates a cross-section depicting the solidification line 137 where the molten metal transitions to solidified metal, or metal that can retain its shape without requiring the mold walls for support and retention. The solidified metal 140 constitutes the formed cast part, such as a billet. Flow through the spout 130 may be controlled within the pouring trough 125, such as by a tapered plug fitting within an orifice connecting a cavity of the pouring trough 125 with a flow channel through the spout 130. Flow of metal through the spout 130 continues as the platform 120 continues to descend along arrow 145 into the casting pit. When the casting operation is to end, either by the platform being at the bottom of its travel, the metal supply running low, or the cast part reaching the completed size, the flow of metal through the spout 130 stops, and the spout assembled on the trough is removed from the molten pool of metal 135 to allow the molten pool to solidify and complete the cast part.

FIG. 2 illustrates an example embodiment of a hot top casting method of the direct chill casting process according to the present disclosure including a continuous casting mold 105, trough 126, and thimble 131 for supplying molten metal from the trough to the cavity of the mold. The illustrated embodiment of FIG. 2 includes a starting position where the tip of the thimble 131 is positioned proximate the starter block 115 which is supported by the platform 120. The starter block 115 is positioned atop platform 120 and aligned to cooperate with the mold 105 to seal the mold cavity and preclude molten metal 107 from leaking from between the continuous casting mold 105 and the starter block 115. The thimble 131 or thimble is received into a transition plate 200 that is securely attached to the top of the mold 105, such as by threaded engagement. The transition plate 200 may be secured to the mold 105 by a metal ring that is threaded into a round opening atop the billet mold 105 to hold the transition plate securely to the mold. The mold 105 may be of a metal such as aluminum, while the thimble 131 and transition plate 200 are generally formed of a refractory material that is resilient to heat.

FIG. 2 depicts the start of a cast with the starter block 115 aligned with the continuous casting mold 105. As the cast starts shown in FIG. 3, the platform 120 descends with the starter block 115 as molten metal flows through the thimble 131 from the trough 126, and solidifies on the starter block 115 and at the bottom of the mold cavity forming the cast part 140. In this manner, as the starter block 115 descends away from the continuous casting mold 105, the cast part, shown in FIG. 4 as 140, is formed. FIG. 4 illustrates the run-state phase of the casting process or the steady-state portion where the platform 120 descends at a near constant rate with the cast part 140 growing accordingly. FIG. 2 also illustrates spray jets 150 that provide a coolant or cooling fluid to the surface of the casting.

In order for the casting process to begin properly, the starting head 115 has to be aligned with the mold cavity 107 of the continuous casting mold 105. Any misalignment may result in molten metal escaping from the mold cavity before it has had the chance to solidify. Molten metal escaping from the mold cavity between the mold and the starter block before it has a chance to solidify will spill into the pit into which the platform 120 descends, which results not only in a lost cast part, but requires substantial cleaning of the pit and any affected components within the pit before casting may resume or start again. Further, continuous casting molds and starting heads are precisely machined and somewhat susceptible to damage, such that if a starting head is brought into engagement with a mold and the two components are not properly aligned, one or both of the starting head and the mold may be damaged which can adversely affect the ability of the parts to generate a satisfactory casting.

The direct chill casting process requires the cast part to at least partially solidify, particularly at a periphery of the cast part, while in the mold 105. The solidification line 137 of FIGS. 1 and 3 illustrates the cross-section solidification line of a billet whereby at the exit of the mold 105 metal proximate the middle of a casting may remain at least somewhat fluid, while metal proximate the periphery or exterior surface of the casting has solidified. During the start of the casting, the starting head 115 must remain engaged with the mold 105 as the molten metal enters the mold cavity and begins solidification at the starting head and proximate the side walls of the mold. Advancing the starting head 115 before metal solidification is sufficiently complete around the periphery of the casting or at the starting head itself results in molten metal spilling from between the mold 105 and the descending starting head 115 into the casting pit. However, once the metal begins to solidify in the mold 105 and the molten metal solidifies against the starting head, the casting may freeze within the mold and not descend with the starting head 115 as the starting head advances down into the casting pit. To ensure the casting descends with the starting head 115, the starting head may include features to engage the casting such that the casting is pulled from the mold 105 at the beginning of the casting process, when the metal has solidified at the starting block and the starting head begins its descent into the casting pit.

FIG. 5A illustrates a prior art example of a top-view of a starting head 215 for a round continuously cast billet. The starting head 215 includes an edge 205, which may be beveled or chamfered as shown in the illustrated embodiment, where the edge 205 cooperates with a mold to seal a bottom of the direct chill mold for the start of the casting process. FIG. 5B illustrates a section view of the starting head 215 of FIG. 5A taken along section line 210. Visible in the section view is a circumferential groove 220 that extends around the circumference of the starting head 215. As the casting process begins, molten metal flows into the mold cavity and onto the starting head 215. The molten metal flows over the starting head 215 and into the circumferential groove 220. As the molten metal begins to solidify on the starting head and around a periphery of the billet at the mold sidewalls, the starting head may begin to descend into the casting pit.

The circumferential groove 220 of the starting head 115 of FIGS. 5A and 5B may include a clinch angle 225. This clinch angle at an outer edge of the circumferential groove 220 results in the butt of the casting solidifying against the starting head 115 having a lip engaged with the circumferential groove by way of the clinch angle 225. This lip of the casting engaged with the groove of the stating head 115 results in the descending starting block pulling the casting out of the bottom of the mold. This pulling force helps to avoid having the butt of the casting frozen in the direct chill casting mold as the starting head 115 descends into the casting pit. The circumferential groove 220 with the clinch angle 225 causes stresses to build in the butt of the casting as it solidifies against the starting head 115. A button 230 stands proud of a surface of the starting head such that the casting forms around the button 230. As the center of the butt of the casting solidifies around the button 230, the contraction of the cast billet helps keep the casting stable as the casting progresses.

Embodiments described herein provide for a continuous casting starting head configured to clinch a casting for drawing the billet from a continuous casting mold in a manner that reduces stresses within the casting decreasing the likelihood of stress cracks forming in the cast casting. FIG. 6A illustrates an example embodiment of a top-view of a starting head 315 for a round continuously cast billet according to embodiments of the present disclosure. The starting head 315 includes a body 317 and a top surface 319, better illustrated in FIG. 6B. The starting head 315 includes an edge 305 that may be beveled or chamfered as shown in the illustrated embodiment, where the edge 305 cooperates with a mold to seal a bottom of the direct chill mold for the start of the casting process. FIG. 6B illustrates a section view of the starting head 315 of FIG. 6A taken along section line 310. Visible in the top view of FIG. 6A and the section view of FIG. 6B are recesses 320 that extend into a concave surface 340 of the starting head 315. The recesses 320, which may include two or more recesses, extend from a first end of a recess, closest to a center 324 of the top surface 319, to a second end closer to the edge 305 of the starting head. The two or more recesses extend over an arc of less than 180-degrees relative to the center 324 of the top surface 319. In some embodiments, the recesses extend over an arc of less than 90-degrees relative to the center 324 of the top surface, as illustrated in FIG. 6A. The recesses 320 are shallower with respect to the top surface 319 proximate the center 324 of the top surface, and deepest proximate the edge of the starting head. The recesses 320 may include a clinch angle 325 as shown in FIG. 3B at the outermost surface or clinch surface 323 of the recess relative to the center of the starting head. The clinch angle is divergent from an axis parallel to a direction of travel of the starting head into a casting pit during a casting operation. The concave surface of the starting head 315 may be of any substantially concave shape, such as having a continuous, consistent radius, a compound curvature, or other concave shape that is generally tallest at a periphery and lowest proximate the center of the concave surface. In certain embodiments, the center of the surface 340 of the starting head is no more than two inches deeper than an outer edge 345 of the periphery of the surface. The depth of a starting head can be increased, particularly when drain channels are added to or incorporated into the starting head, such as drain channels proximate the center of the starting head to reduce or eliminate water accumulating in the starting head which can have a detrimental impact on the casting.

Detail circle 400 of the cross-section of FIG. 6B is shown enlarged as FIG. 7 and rotated to reflect the horizontal position of the starting head 315 during the casting process. As illustrated, the recess 320 includes a surface defined as the clinch surface 323 of the recess relative to the center of the starting head. The clinch angle 325 of the clinch surface 323 creates a clinch point 321 within the recess whereby the casting is clinched by the starting head 315. The clinch point 321 may effectively be a line rather than a point; however, the term "clinch point" is used to identify in the profile where a cast part is clinched on the profile of the recess, with that point extending along an arc of the recess. The clinch angle 325 is an angle relative to an axis defined along a direction of descent of the starting head into the casting pit. This clinch angle 325 results in an undercut or clinch point 321 formed by the clinch surface 323 where at least a portion of the top surface 340 overlies at least a portion of the recess 320. In this manner, molten metal forms a lip within this undercut clinch point 321 providing a grip of the starting head 315 on the butt of the casting. FIG. 8 illustrates the detail circle of FIG. 7 with casting material 410 (e.g., a molten metal) poured into the mold and solidifying against the starting head 315. As the casting material solidifies a portion of the casting 420 becomes clinched by the clinch point created by the clinch surface 323 of the recess 320 positioned at the clinch angle 325 since the material has flowed into the recess 320 and solidified within the undercut clinch point 321. This engagement enables the starting head 315 to pull the casting down along arrow 430 as the starting head descends into the casting pit. The clinch point resists any pull of the casting along arrow 440 which would occur if the casting material 410 has been hung up or frozen in the direct chill casting mold. Thus, the starting head 315 draws the casting down into the casting pit along arrow 430.

The embodiments of the clinch points in recesses 320 of FIGS. 6 through 8 reduce the amount of stress on the butt of a casting relative to the circumferential groove 220 of FIG. 5 while providing sufficient downward force to extract the casting or billet from the mould. The multiple clinch points positioned around the circumference of the starting head provide stability to the billet without the need of a center button. Embodiments described herein reduce the stress generated during initial solidification of the butt of the casting eliminating internal cracks forming in the steady state cast product. Peak stresses on the solidifying butt of the casting are reduced consequently eliminating radial or surface cracks on the casting, particularly when casting crack sensitive alloys. Further, a stress generating button is not required by embodiments described herein.

The stresses are relieved on the butt of the casting through the concave curvature of the surface 340 of the starting head together with the limited proportion of the butt of the casting engaged by the clinch points created by the clinch angle 325 of the recesses 320. Further, without the clinch points entirely encircling the butt of the casting, the forces applied through the clinching are reduced and distributed around only a portion of the butt of the casting. Embodiments described herein further generate a stable butt of the casting that reduces movement of the cast billet and reduces or eliminates kinking of the billet later in the casting process.

The example embodiment of FIGS. 6A and 6B illustrate a starting head with three recesses 320 each including a clinch surface 323. However, embodiments may include more or fewer recesses and corresponding clinch surfaces. FIG. 9 illustrates an example embodiment of a starting head 415 in which four recesses 420 are formed with four corresponding clinch surfaces 423. The recesses 420 may be formed with contours, such as the contoured sides 421 of the illustrated embodiment that facilitates release of the cast billet from the starting head 415. The contoured recesses 420 lacking sharp angles renders the cast billet more easily separated from the starting head 415 after the casting process is finished. Further, the lack of sharp angles in the recesses 420 or on the surface of the starting head reduces points of potential stress introduction into the butt of the casting, thereby reducing internal stresses of the casting and decreasing the likelihood of cracks within the casting, particularly in crack-prone alloys.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A starting head for a continuous casting mold system comprising:

a circular body;

a top surface of the circular body, wherein the top surface is concave, wherein two or more recesses are defined within the top surface, wherein each recess extends from a first end to a second end along a bottom surface, wherein the first end of a respective recess is closer to a center of the top surface than the second end of the respective recess, wherein a depth of the first end of the respective recess relative to the top surface is less than a depth of the second end of the respective recess relative to the top surface, and wherein a center of the top surface is positioned lower in the continuous casting mold system than the bottom surface of each recess; and a clinch point defined by the second end of the respective recess.

2. The starting head of claim 1, wherein in response to molten casting material received onto the starting head, the casting material solidifies within the two or more recesses defined within the top surface, and the clinch point defined by the second end of the respective recess engage the casting material which has been solidified enabling the starting head to draw the casting material which has been solidified from a continuous casting mold.

3. The starting head of claim 2, wherein each of the two or more recesses extend along an arc of less than 180-degrees relative to the center of the top surface.

4. The starting head of claim 3, wherein each of the two or more recesses define a clinch surface at the second end of the respective recess, the clinch surface extending from the top surface to a bottom of the respective recess at the depth of the second end of the respective recess.

5. The starting head of claim 4, wherein the clinch surface of the respective recess defines an undercut, where at least a portion of the top surface overlies the respective recess.

6. The starting head of claim 4, wherein the clinch surface is positioned at a clinch angle divergent from an axis parallel to a direction of travel of the starting head into a casting pit during a casting operation.

7. The starting head of claim 1, wherein the two or more recesses are positioned with centers spaced in equal angular increments about the center of the top surface of the circular body.

8. The starting head of claim 1, wherein the two or more recesses comprise three recesses positioned with centers 120-degrees apart from one another relative to the center of the top surface of the circular body.

9. The starting head of claim 1, wherein the two or more recesses comprise four recesses positioned with centers 90-degrees apart from one another relative to the center of the top surface of the circular body.

10. The starting head of claim 1, wherein a height difference between an outer edge of the top surface of the circular body and a height of a lowest point of the top surface is no more than two inches.

11. The starting head of claim 10, wherein a maximum depth of the two or more recesses relative to the outer edge of the top surface is no more than two inches.

12. A continuous casting mold system comprising:

a continuous casting mold defining a mold cavity;

a starting head comprising a circular top surface, the starting head configured to engage a bottom of the continuous casting mold and seal a bottom side of the mold cavity with the circular top surface;

wherein two or more recesses are defined within the circular top surface, wherein each recess extends from a first end to a second end along a bottom surface, wherein the first end of a respective recess is closer to a center of the circular top surface than the second end of the respective recess, wherein a depth of the first end of the respective recess relative to the circular top surface is less than a depth of the second end of the respective recess relative to the circular top surface, and wherein a center of the circular top surface is positioned lower in the continuous casting mold system than the bottom surface of each recess; and a clinch point defined by the second end of the respective recess.

13. The system of claim 12, wherein each of the two or more recesses extend along an arc of less than 180-degrees relative to the center of the circular top surface.

14. The system of claim 13, wherein each of the two or more recesses define a clinch surface at the second end of the respective recess, the clinch surface extending from the circular top surface to a bottom of the respective recess at the depth of the second end of the respective recess.

15. The system of claim 14, wherein the clinch surface of the respective recess defines an undercut, where at least a portion of the circular top surface overlies the respective recess.

16. The system of claim 14, wherein the clinch surface is positioned at a clinch angle divergent from an axis parallel to a direction of travel of the starting head into a casting pit during a casting operation.

17. The system of claim 12, wherein the two or more recesses comprise three recesses positioned with centers 120-degrees apart from one another relative to a center of the circular top surface of the starting head.

18. The system of claim 12, wherein the two or more recesses comprise four recesses positioned with centers 90 degrees apart from one another relative to a center of the circular top surface of the starting head.

19. The system of claim 12, wherein the circular top surface of the starting head is concave, wherein a height difference between an outer edge of the circular top surface of the starting head and a height of a lowest point of the circular top surface is no more than two inches, and wherein a maximum depth of the two or more recesses relative to the outer edge of the circular top surface is no more than two inches.

* * * * *